US008701323B2

(12) United States Patent
Fenton

(10) Patent No.: US 8,701,323 B2
(45) Date of Patent: Apr. 22, 2014

(54) ROLLING INFORMATION DISPLAY FOR ROLLER GRILL

(75) Inventor: Paula Sanders Fenton, Dallas, TX (US)

(73) Assignee: 7-Eleven, Inc., Dallas, TX (US)

( * ) Notice: Subject to any disclaimer, the term of this patent is extended or adjusted under 35 U.S.C. 154(b) by 0 days.

(21) Appl. No.: 13/344,734

(22) Filed: Jan. 6, 2012

(65) Prior Publication Data

US 2012/0102795 A1 May 3, 2012

Related U.S. Application Data

(63) Continuation of application No. 12/497,430, filed on Jul. 2, 2009, now Pat. No. 8,112,920.

(60) Provisional application No. 61/077,995, filed on Jul. 3, 2008.

(51) Int. Cl.

| | |
|---|---|
| ***G09F 3/00*** | (2006.01) |
| ***G09F 11/02*** | (2006.01) |
| ***G09F 23/00*** | (2006.01) |

(52) U.S. Cl.

CPC ..... *G09F 3/0295* (2013.01); *G09F 11/02* (2013.01); *G09F 23/00* (2013.01)

USPC ..... 40/660; 40/506

(58) Field of Classification Search

None

See application file for complete search history.

(56) References Cited

U.S. PATENT DOCUMENTS

| | | | |
|---|---|---|---|
| 1,585,289 | A | 5/1926 | Holdsworth |
| 1,830,410 | A | 11/1931 | Schaaf et al. |
| RE19,593 | E | 5/1935 | Hansen |
| 2,958,251 | A | 11/1960 | Calabro |
| 3,548,738 | A | 12/1970 | Hildebrand at al. |
| 4,021,953 | A | 5/1977 | Couch |
| 4,324,511 | A | 4/1982 | Irish |
| 4,337,104 | A | 6/1982 | Lynn |
| 5,060,813 | A | 10/1991 | Gollasch et al. |
| 6,009,653 | A | 1/2000 | Harrington |
| 6,089,483 | A | 7/2000 | St-Laurent |
| 6,276,877 | B1 | 8/2001 | Crawford |

(Continued)

FOREIGN PATENT DOCUMENTS

| | | |
|---|---|---|
| WO | WO-03071908 | 9/2003 |
| WO | WO 2010/003128 | 1/2010 |

OTHER PUBLICATIONS

International Search Report mailed Jan. 9, 2009 for International Appl. No. PCT/US2009/049632, 7 pages.

(Continued)

*Primary Examiner* — Joanne Silbermann
*Assistant Examiner* — Christopher e Veraa
(74) *Attorney, Agent, or Firm* — Gardere Wynne Sewell LLP

(57) ABSTRACT

In one aspect, a rolling information display apparatus for use with a roller grill includes an elongated envelope. A cap is removably positioned over at least one opening of the envelope. An information bearing medium is removably positioned inside the envelope. In one embodiment, a sealing member is disposed to create a substantially watertight seal over at least one opening of the envelope. In another aspect, a rolling information display apparatus for use with a roller grill is a cylindrical rolling member having one or more rolling surfaces rolling in contact with heated rolling surfaces of the grill. The cylindrical rolling member also has one or more recessed surfaces bearing information about food items offered for sale on the grill. The recessed surfaces are provided in regions of the rolling member that are of diameter less than regions of the rolling member in which the rolling surfaces are provided.

19 Claims, 11 Drawing Sheets

(56) References Cited

U.S. PATENT DOCUMENTS

| | | | |
|---|---|---|---|
| 6,474,223 | B2 | 11/2002 | Kurmlavage |
| 6,756,068 | B1 | 6/2004 | Kafentzis et al. |
| D499,346 | S | 12/2004 | Kurmlavage |
| D510,879 | S | 10/2005 | Kurmlavage |
| 7,367,261 | B2 | 5/2008 | Gaskill et al. |
| 2004/0083902 | A1 | 5/2004 | Gaskill et al. |
| 2004/0189156 | A1 | 9/2004 | Pearlman |
| 2005/0051037 | A1 | 3/2005 | Gaskill et al. |
| 2005/0144818 | A1 | 7/2005 | Zilberman |
| 2006/0037486 | A1 | 2/2006 | Kurmlavage |
| 2010/0000135 | A1 | 1/2010 | Fenton |

OTHER PUBLICATIONS

Written Opinion of the International Searching Authority mailed Jan. 9, 2009 for International Appl. No. PCT/US2009/049632, 5 pages.

ROLLING INFORMATION DISPLAY FOR ROLLER GRILL

CROSS-REFERENCE TO RELATED APPLICATIONS

Pursuant to 35 U.S.C. §120, this continuation patent application claims priority from co-pending U.S. patent application Ser. No. 12/497,430, entitled Rolling Information Display for Roller Grill, naming Paula Sanders Fenton as inventor, filed Jul. 2, 2009, which pursuant to 35 U.S.C. §119(e), claims the benefit of U.S. Provisional Patent Application Ser. No. 61/077,995, entitled Rolling Information Display for Roller Grill, naming Paula Sanders Fenton as inventor, and filed Jul. 3, 2008. The contents of these aforementioned United States Patent Applications are incorporated by reference herein in their entirety for any and all purposes.

TECHNICAL FIELD OF THE INVENTION

The present invention relates generally to a rolling information display apparatus for use with a roller grill.

BACKGROUND OF THE INVENTION

Roller grills are often used at today's convenience stores and concession stands. These roller grills are employed to heat food items such as hot dogs and taquitos. The food items rest on heated rollers that rotate and cause the food items to roll while absorbing heat from the roller surfaces. These roller surfaces are typically made of chrome and/or coated with a non-stick material, such as knurreled TEFLON™. An example type of roller grill is available from Star Manufacturing, Inc.

Customers interested in the food items need to receive information about the items, such as prices. However, food items on the roller grill cannot be labeled by conventional means. One way to provide this information is to have a menu mounted to a wall, but space in retail locations is at a premium, and food items often change throughout the day.

One other way of providing information to customers about the food items relates to encasements for the roller grills. The roller grills are typically encased in glass cases, under sneeze guards, or otherwise shielded to prevent contamination of food, and to prevent injuries. Placing information about the food items on the encasements for the roller grills is one way of informing customers. However, the tops of the cases are often employed as counter space or oriented away from the customers. Additionally, placing information on the fronts of the cases blocks customers' views of the food items.

An alternative way of providing information about food items to customers is to provide a display inside the encasements that avoids obscuring view of the food items. In one example, rails are mounted inside the encasements in proximity to the rollers and oriented perpendicular to the rollers, and displays are mounted to the rails. However, these rails and displays prevent food items from being easily removed from the case or moved around on the grill, and the displays block customer views of the food items to some degree. Further, these rails and displays are expensive and are often difficult to clean.

Some attempts at supplying the information have also involved inserting stationary items on and/or between the rollers. These items have obstructed views and hamper removal and rearrangement of food items. Perhaps more importantly, these items often make contact with the rollers causing damage to the surface of the rollers of the grill due to friction when contacting with the rolling surfaces.

SUMMARY OF THE INVENTION

In one aspect, a rolling information display apparatus for use with a roller grill includes an elongated envelope that is at least partially non-opaque or clear and that contains at least one offering. A cap is removably engagable with the envelope to cover at least one opening of the envelope. An information bearing medium is removably positioned inside the envelope through the opening. In some embodiments, a sealing member is disposed over the opening to create a seal, such as a substantially water-tight seal. In certain embodiments this seal may be positioned between the envelope and the cap when the cap is engaged with the envelope. In another aspect, a rolling information display apparatus for use with a roller grill is a cylindrical rolling member having one or more rolling surfaces rolling in contact with heated rolling surfaces of the grill. The cylindrical rolling member also has one or more recessed surfaces bearing information about food items offered for sale on the grill. The recessed surfaces are provided in regions of the rolling member that are of diameter less than regions of the rolling member in which the rolling surfaces are provided.

Depending on the particular embodiment, various other aspects may be provided.

BRIEF DESCRIPTION OF THE DRAWINGS

FIG. 2, including

FIG. 3, including

FIG. 4, including

FIG. 5, including

FIG. 6, including

DETAILED DESCRIPTION OF THE INVENTION

Figure 1:
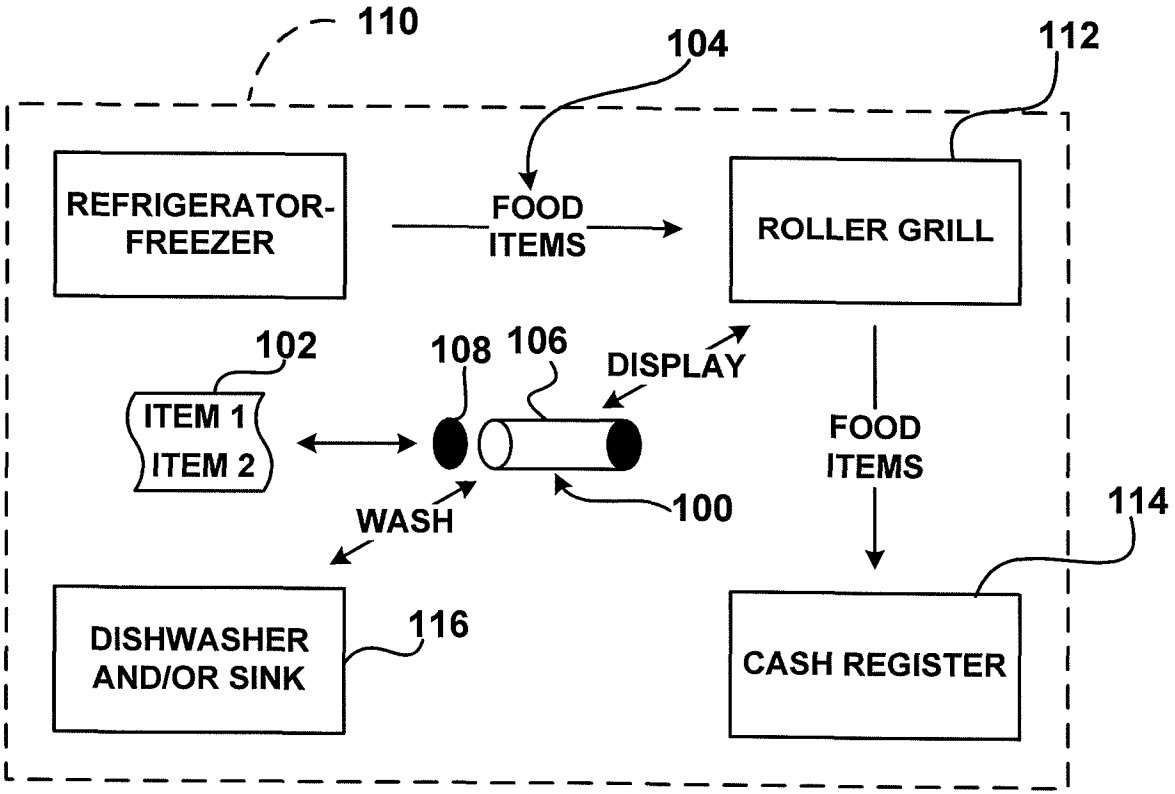
FIG. 1 is a block diagram illustrating a rolling information display apparatus employed in a retail environment with a roller grill.

In the following description, like numbers refer to like elements.

The following disclosure is directed toward a rolling information display apparatus and method. Starting with FIG. 1, the apparatus 100 is partly composed of an information bearing medium 102 on which information about food items 104 is printed. An example of the medium 102 is PROPRINT™, which is a synthetic printed material, such as plastic paper made of talc-filled polyethylene. This medium 102 in certain embodiments is heat resistant up to three-hundred fifty degrees Fahrenheit.

An example of the information or messages provided on medium 102 may include the prices of food item. For example, a name and price of one food item is printed on a top half of a page of plastic paper, and a name and price of the same or another food item is printed on a bottom half of the same side of the page. Then the page is rolled into a tube with the printed side facing outwards and the food item names and prices oriented to face opposite one another. The information or message is then visible through a portion of area of the apparatus 100 that is at least non-opaque, clear, or transparent in the visible light spectrum.

The apparatus 100 in certain embodiments may be composed of an elongated envelope 106 that is generally cylindrical in shape. In some embodiments, the envelope 106 is a length of high heat resistant polycarbonate tubing. In some embodiments, the tubing is clear tubing and is open on one or both ends. Any of a variety of materials are suitable for use in the present invention. In a preferred embodiment, these materials are heat resistant at temperatures at which roller grills operate, and are safe for use with food equipment. In certain embodiments, the materials are regulatory approved, such as FDA approved and/or NSF approved.

The rolled page of medium 102 is placed into the envelope 106. In some embodiments, the page is sized to fit in the envelope 106 with the outer surface of the page resting against the inner surface of the envelope and with the food item names and prices revealed. In other words, the page is not so large or the tube so small that the page, in order to fit into the tube, must be rolled so as to obscure any part of the information. In some embodiments, the height of the page is equal to the circumference of the tubing, or is not significantly larger than the circumference of the tubing. In other embodiments, the medium 102 is placed around the exterior of the outer surface of the envelope. In such a case, the envelope may not include a non-opaque or clear portion.

The apparatus 100 may, in certain embodiments, include a cap 108 that removably engages with the envelope 106. In some embodiments, the cap 108 is made of high heat resistant polycarbonate. In some embodiments, the cap 108 is made of high heat resistant silicon. In some embodiments, the cap 108 engages with an open end of a tubular envelope. In some embodiments, two caps engage with two openings of a tubular envelope.

In some embodiments, the cap 108 is engaged with the envelope 106 to seal the medium 102 in the envelope 106 and thereby create a low humidity environment for the medium 102. In other words, there is little or no moisture present in the sealed apparatus 100. As a result, the interior surface of the envelope 106 does not fog over when placed on rolling, heated surfaces of a roller grill during a grilling operation of the roller grill, and the medium does not degrade. This feature, in a preferred embodiment, provides a water-tight seal during a dish washing or dish washer cycle. This allows the apparatus 100 to be cleaned and sanitized, while ensuring that the inside of the envelope 106 and the medium 102 stays dry. In some embodiments, the cap 108 is engaged with the envelope 106 in a humidity controlled environment in which the humidity is controlled to be low. In some embodiments, personnel at a retail location 110 engage the cap 108 with the envelope in a humidity controlled environment at the retail location 110. In some embodiments, the cap 108 is engaged with the envelope 106 before the apparatus 100 is shipped to the retail location 110.

Figure 2A:
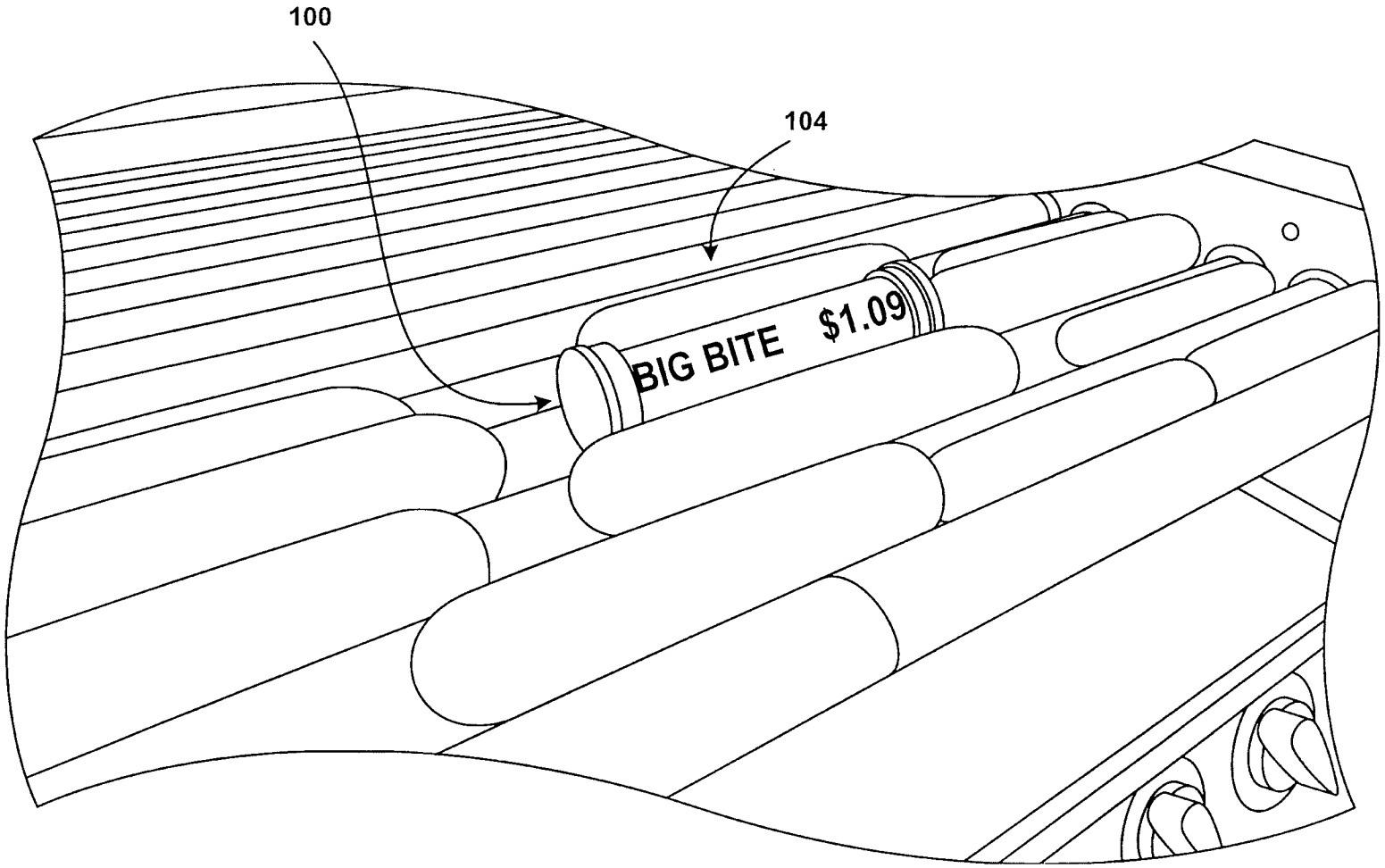
FIG. 2A and FIG. 2B, is a pair of perspective views illustrating a rolling information display apparatus disposed on a roller grill together with food items.
Figure 2B:
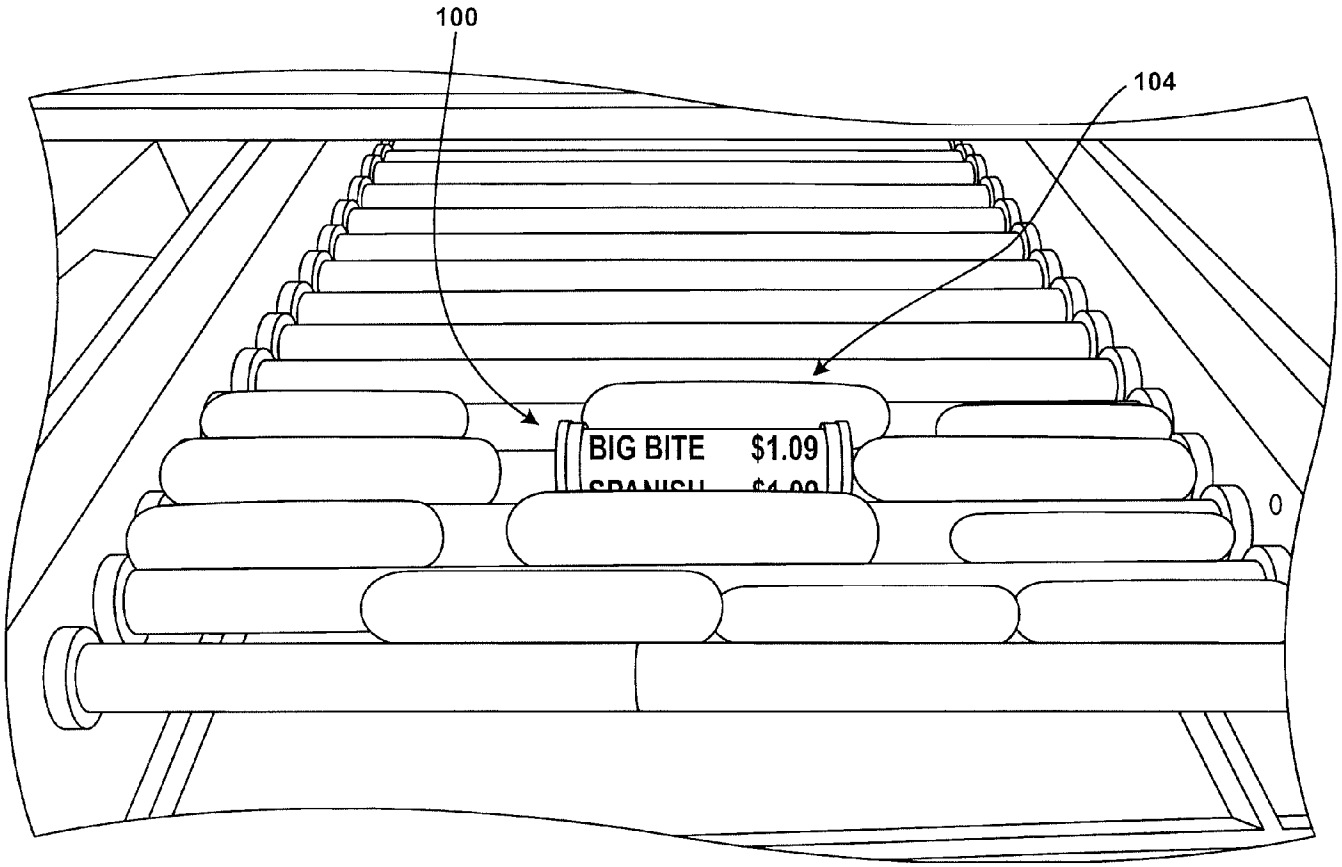

Turning now also to FIG. 2 and referring generally to FIG. 1, FIG. 2A, and FIG. 2B, the rolling information display apparatus 100 is placed on rolling, heated surfaces of a roller grill 112 together with food items 104 about which information is provided on the information bearing medium 102. The rolling display apparatus 100 is configured to roll on the roller grill 112 together with the food items. In some embodiments, names and prices of different food items 104 are alternately revealed by the rolling action of the rolling display apparatus 100. In some embodiments, these prices constitute unilateral contractual offers to customers in a retail environment 110, such as a convenience store. In some embodiments, customers purchase the food items 104 at a cash register 114 in the retail environment 110, and the contractual terms are honored by personnel in the retail environment.

In some embodiments, personnel in the retail environment 110 periodically remove the rolling display apparatus 100 from the roller grill 112 and wash it. The rolling display apparatus 100, in a preferred embodiment, is substantially airtight and watertight to prevent moisture from entering the apparatus 100 during washing by hand or machine 116. In additional or alternative embodiments, personnel in the retail environment periodically remove the rolling display apparatus 100 from the roller grill 112 and send it offsite for cleaning.

In some embodiments, personnel in the retail environment periodically disengage the cap 108 from the envelope 106 and replace the medium 102 with a new medium 102 having new information or messages about new food items 104, additional food items 104, new contractual terms, and/or additional contractual terms or other messages. The personnel then reseal the envelope and replace the apparatus 100 on the grill 112. In additional or alternative embodiments, personnel in the retail environment 110 receive a new apparatus 100 and replace an old apparatus 100 with the new apparatus 100, which can have new and/or additional information printed on its medium 102.

Figure 3A:
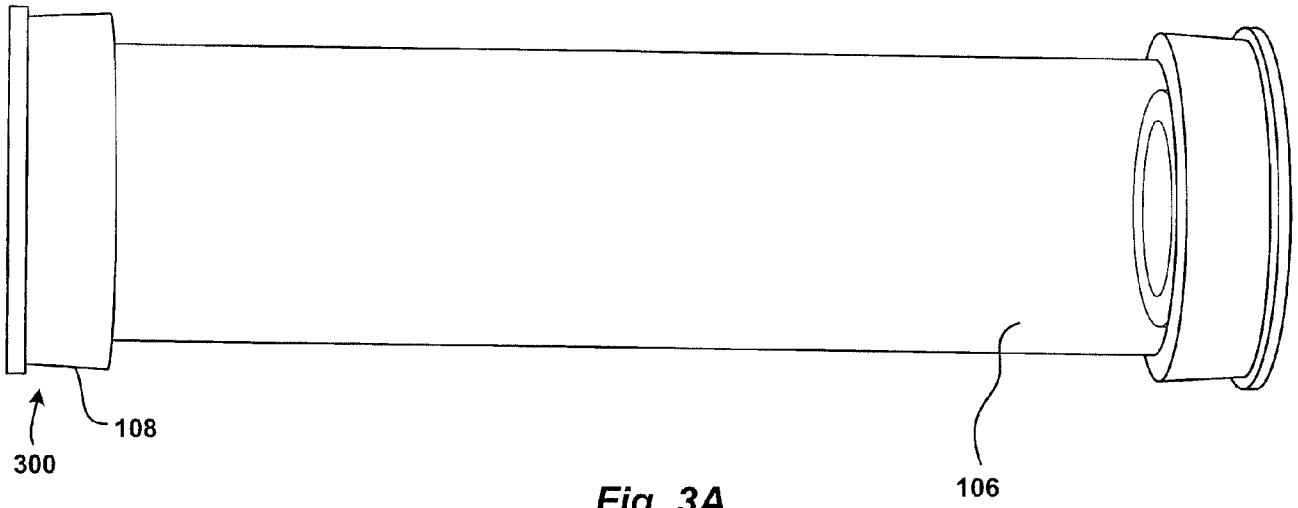
FIG. 3A and FIG. 3B, is a pair of perspective views illustrating a first embodiment of a rolling information display apparatus for use with a roller grill.
Figure 3B:
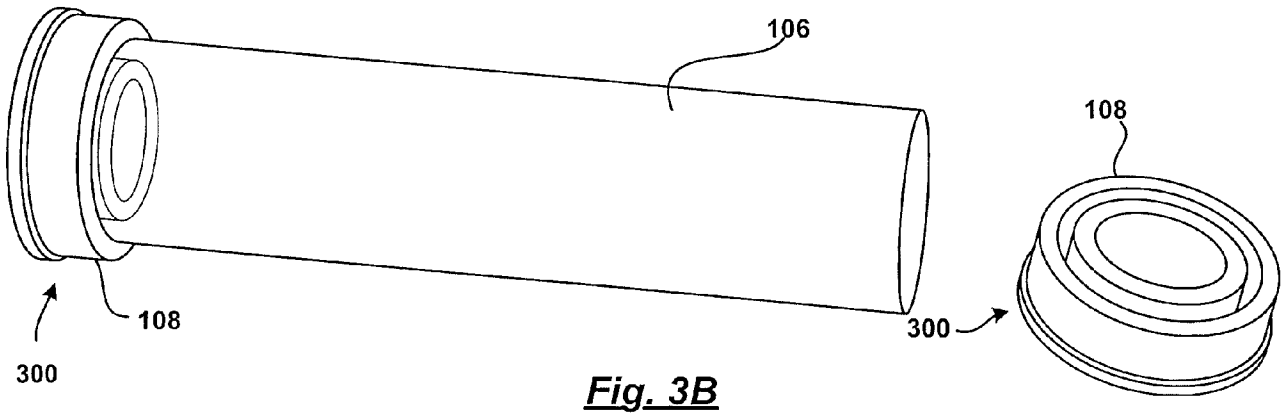

Turning now to FIG. 3A and FIG. 3B and referring generally thereto, a first embodiment of the rolling display apparatus is composed in part of an envelope 106 made of a tube of clear material, such as a heat resistant polymer such as a polycarbonate. In this embodiment the tube is open on both ends. A pair of caps 108 are configured to engage the tube by slipping onto the exposed ends of the tube and adhering by friction to the tube. These caps 108 are made, for example, from polycarbonate or silicone rubber. The caps 108 each have a circular wheel section 300 formed to contact the rolling heated surfaces of the roller grill. The diameters of the wheel section of the caps 108 are larger than the other diameters of the apparatus. Therefore, it is ensured that only the wheel regions of the caps 108 contact the grill during rolling operation, which avoids transfer of grease and other material from the surface of the grill to the surface of the envelope 106, and minimizes wear to and from the caps 108, such as wear to the roller grill roller surfaces, which may include a TEFLON coating. In other embodiments, the portions of the caps 108 that contact the roller grill are not positioned at the far ends of the apparatus 100.

Figure 4A:
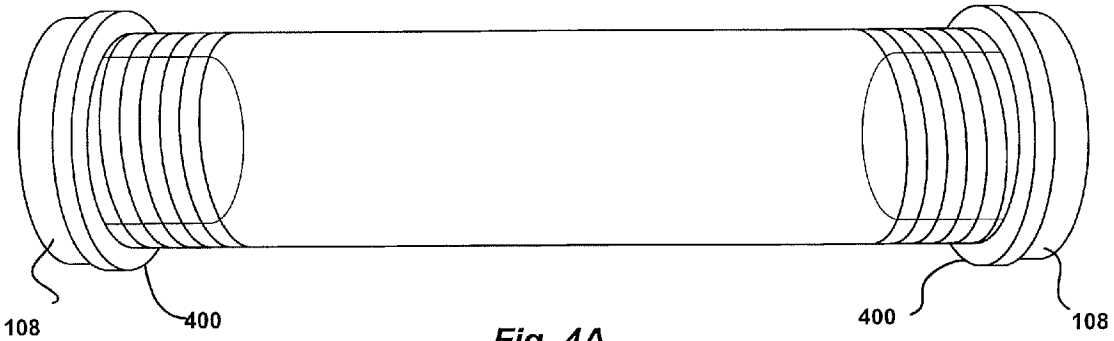
FIG. 4A, FIG. 4B, and FIG. 4C, is a set of perspective views illustrating a second embodiment of a rolling information display apparatus for use with a roller grill.
Figure 4B:
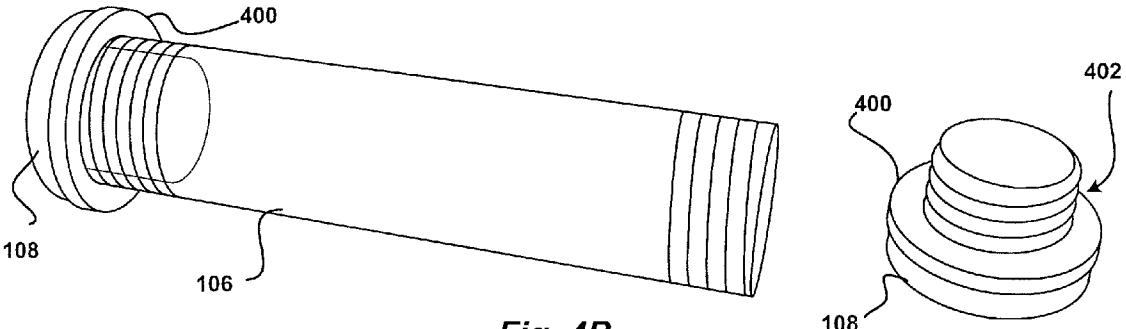
Figure 4C:
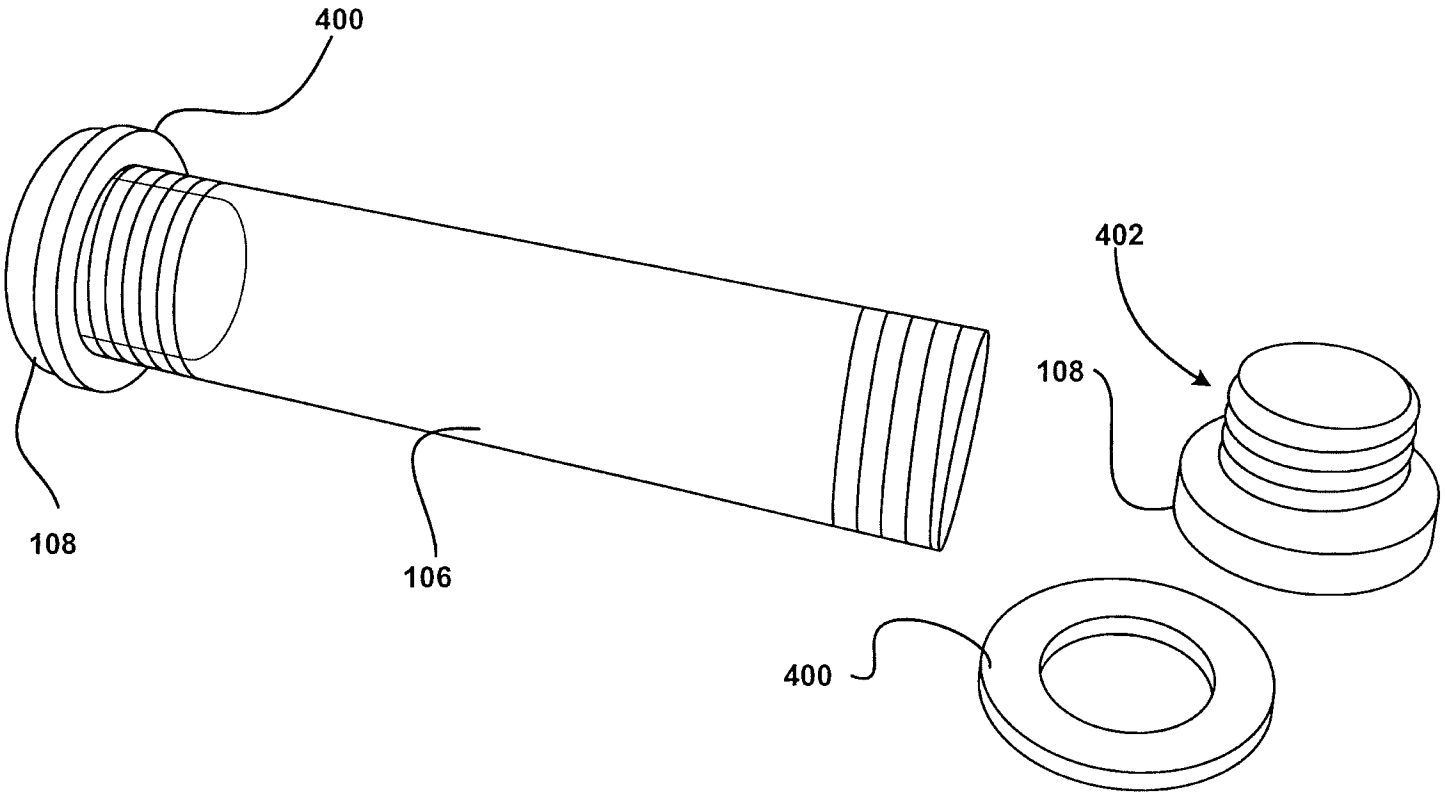

Turning now to FIG. 4A, FIG. 4B, and FIG. 4C and referring generally thereto, an alternative embodiment of the apparatus is composed in part of an envelope 106 made of a tube of clear material, such as polycarbonate. This tube is open on both ends and the ends of the tube are threaded on the inside. In other embodiments the threads are on the outside. A pair of caps 108 each have a threaded insert section 402 that is configured to engage the tube by slipping into the exposed ends of the tube and engaging the threads on the inside of the tube. These caps 108 are made, for example, from polycarbonate or silicon. A pair of sealing members in the form of O-rings 400 are configured to slip over the threaded insert sections 402 and create a substantially airtight and watertight seal when the caps 108 are engaged with the envelope 106. The O-rings are made, for example, from a high heat resistant silicon with a designated or desired hardness/softness. These O-rings are circular and have a diameter greater than the diameters of the envelope 106 and caps 108. Therefore, the O-rings 400 are configured to continuously contact the rolling, heated surfaces of a roller grill during a grilling operation while lifting the envelope 106 and caps 108 away from the grill surfaces. As a result, transfer of grease and other material from the surface of the grill to the surfaces of the envelope 106 and caps 108 is avoided, and wear to and from the envelope 106 and caps 108 is avoided or minimized. In other embodiments, the O-rings rings 400 are integrated as part of the caps 108.

Figure 5A:
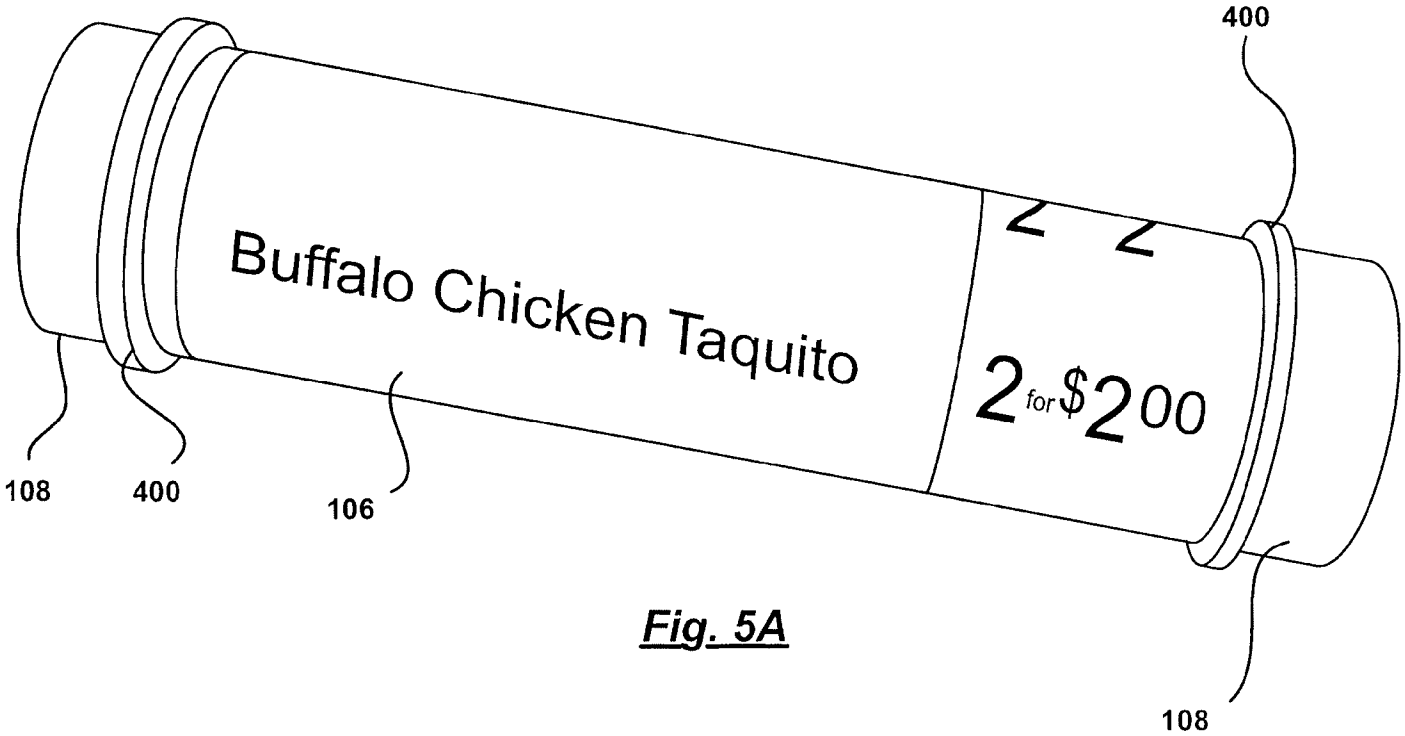
FIG. 5A, FIG. 5B, and FIG. 5C, is a set of perspective views illustrating a third embodiment of a rolling information display apparatus for use with a roller grill.
Figure 5B:
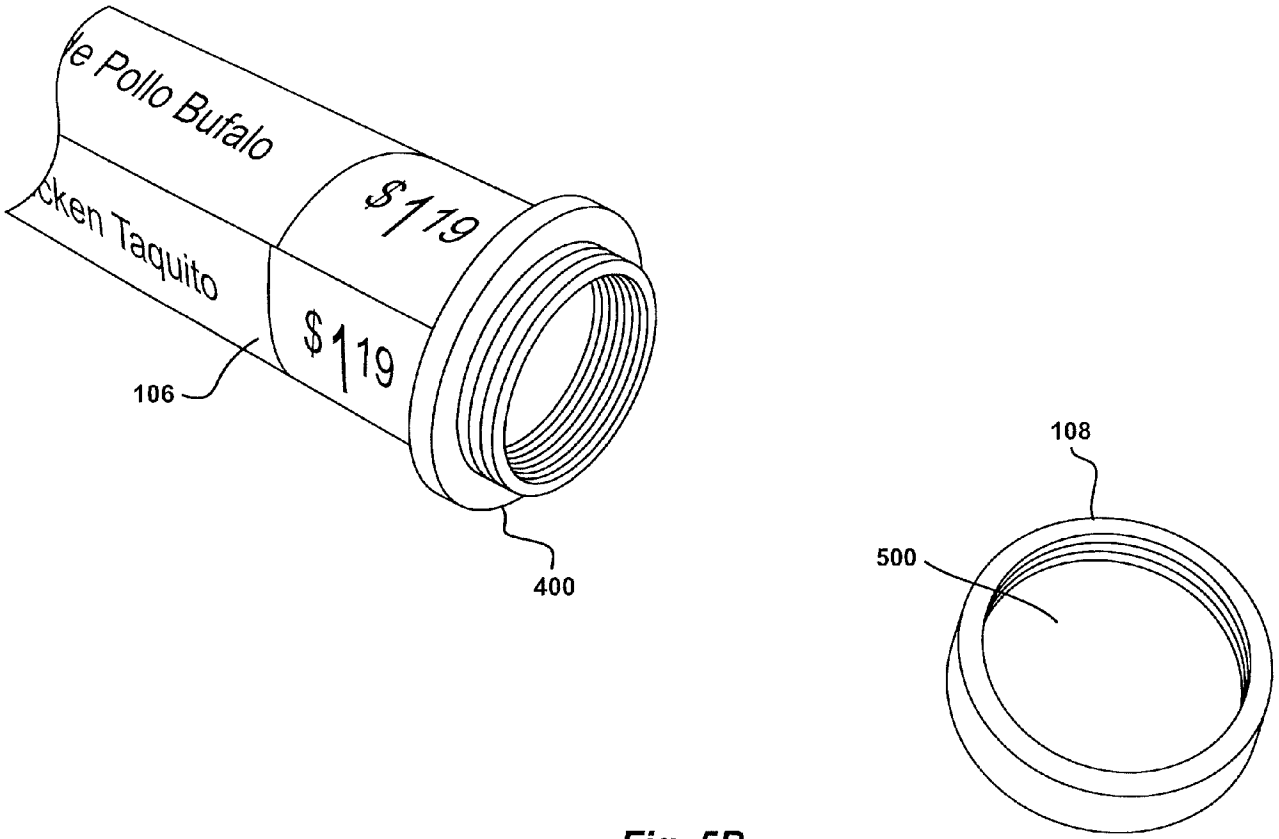
Figure 5C:
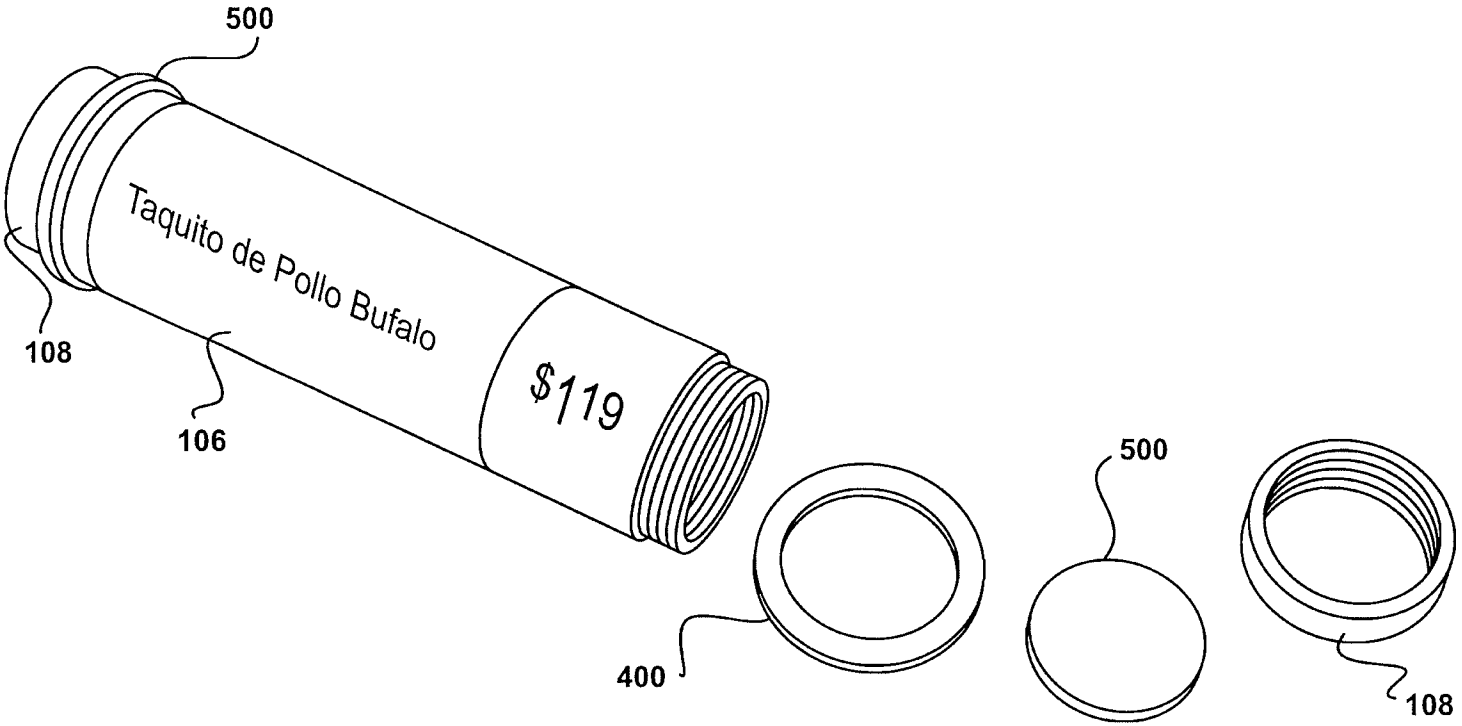

Turning now to FIG. 5A, FIG. 5B, and FIG. 5C and referring generally thereto, yet another embodiment of the apparatus is composed in part of an envelope 106 made of a tube of clear material, such as polycarbonate. This tube is open on both ends and the ends of the tube are threaded on the outside. A pair of caps 108 are threaded on the inside and configured to engage the tube by screwing onto the exposed ends of the tube and engaging the threads on the outside of the tube of envelope 106. These caps 108 are made, for example, from polycarbonate or silicon. A pair of sealing members in the form of O-rings 400 are configured to slip over the externally threaded ends of the tube and create a substantially airtight and watertight seal when the caps 108 are engaged with the envelope 106. The O-rings are made, for example, from high heat resistant silicon. An additional pair of sealing members in the form of stoppers 500 that fit between the ends of the tube 106 and the cap 108 to assist in creating the airtight and watertight seal. The stoppers 500 are made, for example, from high heat resistant silicon. In some embodiments, the stoppers 500 can instead be formed O-rings.

The O-rings 400 are circular and have a diameter greater than the diameters of the envelope 106 and caps 108. Therefore, the O-rings 400 are configured to continuously contact the rolling, heated surfaces of a roller grill during a grilling operation while lifting the envelope 106 and caps 108 away from the grill surfaces. As a result, transfer of grease and other material from the surface of the grill to the surfaces of the envelope 106 and caps 108 is avoided, and wear to and from the envelope 106 and caps 108 is avoided or minimized. In other embodiments, the O-rings 400 may be positioned over the tube of the envelope 106 closer to the middle of the apparatus 100. In such an embodiment, the O-rings 400 may not serve to seal the ends or openings of the apparatus 400.

Figure 6A:
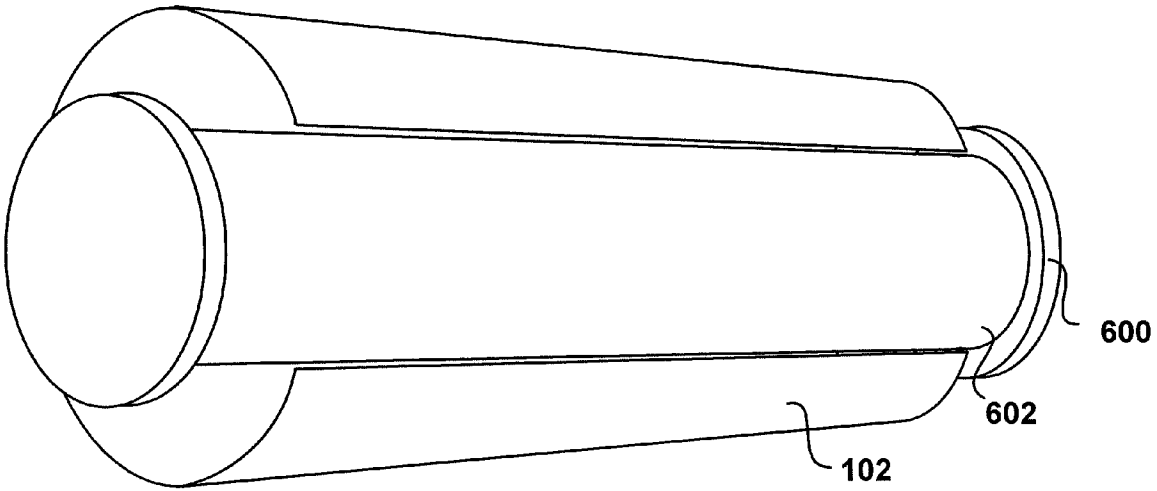
FIG. 6A and FIG. 6B, is a set of perspective views illustrating a fourth embodiment of a rolling information display apparatus for use with a roller grill.
Figure 6B:
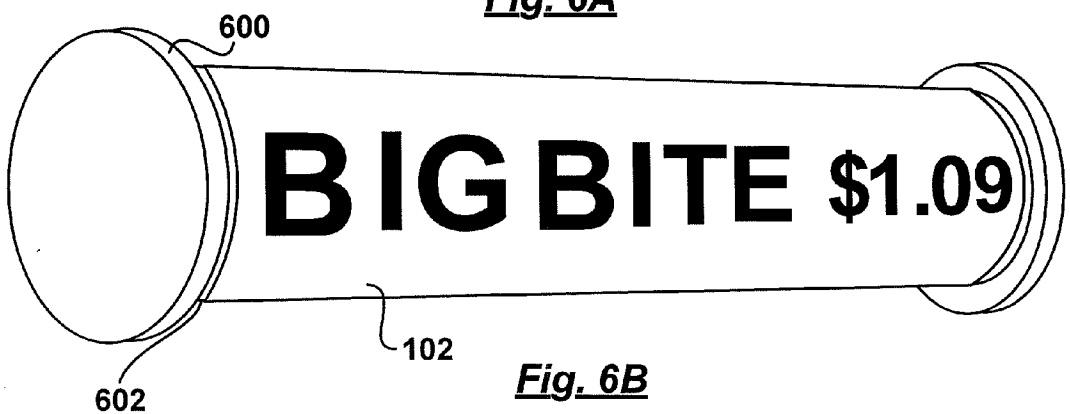

Turning now to FIG. 6A and FIG. 6B and referring generally thereto, a further embodiment of the apparatus is composed in part of a cylindrical rolling member having one or more rolling surfaces 600 for rolling in contact with heated rolling surfaces of a roller grill. The cylindrical rolling member also has one or more recessed surfaces 602 for bearing information, such as about the food items offered for sale on the roller grill. The recessed surfaces 602 are provided in regions of the rolling member that are of diameter less than regions of the rolling member in which the rolling surfaces are provided. The rolling member can be formed of polycarbonate, glass, metal, rubber, plastic, or any other suitable or desirable materials.

The information will preferably concern the food items and can be disposed or positioned in and/or on the recessed surfaces 602 in numerous ways. For example, the information bearing medium 102 can be attached to the recessed surfaces 602 by glue, adhesive or other suitable attachment mechanism, such as shrink wrap, friction fit, bonded, and the like. The information bearing medium 102 can be a sheet that is wrapped around the member, such as recessed surfaces 602. Alternatively or additionally, the medium 102 can be a tube that slides onto the member. In this case, one or more of the rolling surfaces 600 may be detached so that the tube can slide onto the recessed surfaces, and the rolling surfaces 600 can be reattached or attached directly to the medium. Alternatively or additionally, the information can be printed, painted, or otherwise directly applied to the recessed surfaces 602. In this case, the recessed surfaces 602 serve as the information bearing medium 102. Alternatively or additionally, the information can be written into the recessed surfaces 602 by etching, molding, carving, embossing, or any other means. In this case, also, the recessed surfaces 602 serve as the information bearing medium 102. When the recessed surfaces 602 serve as the information bearing medium 102, it is envisioned that the rolling surfaces 600 can be detachable in certain embodiments. Thus, an entirely new rolling member can be sent to a retail location to replace an existing rolling member, or a new information bearing medium can be sent to replace an existing information bearing medium. This information bearing medium can be a sheet or a tube. The tube can be configured to slidingly engage with a reusable recessed surface region of the rolling member, or the tube can serve as a new recessed surface region and engage with disengagable, reusable rolling surface regions of the rolling member.

Figure 7:
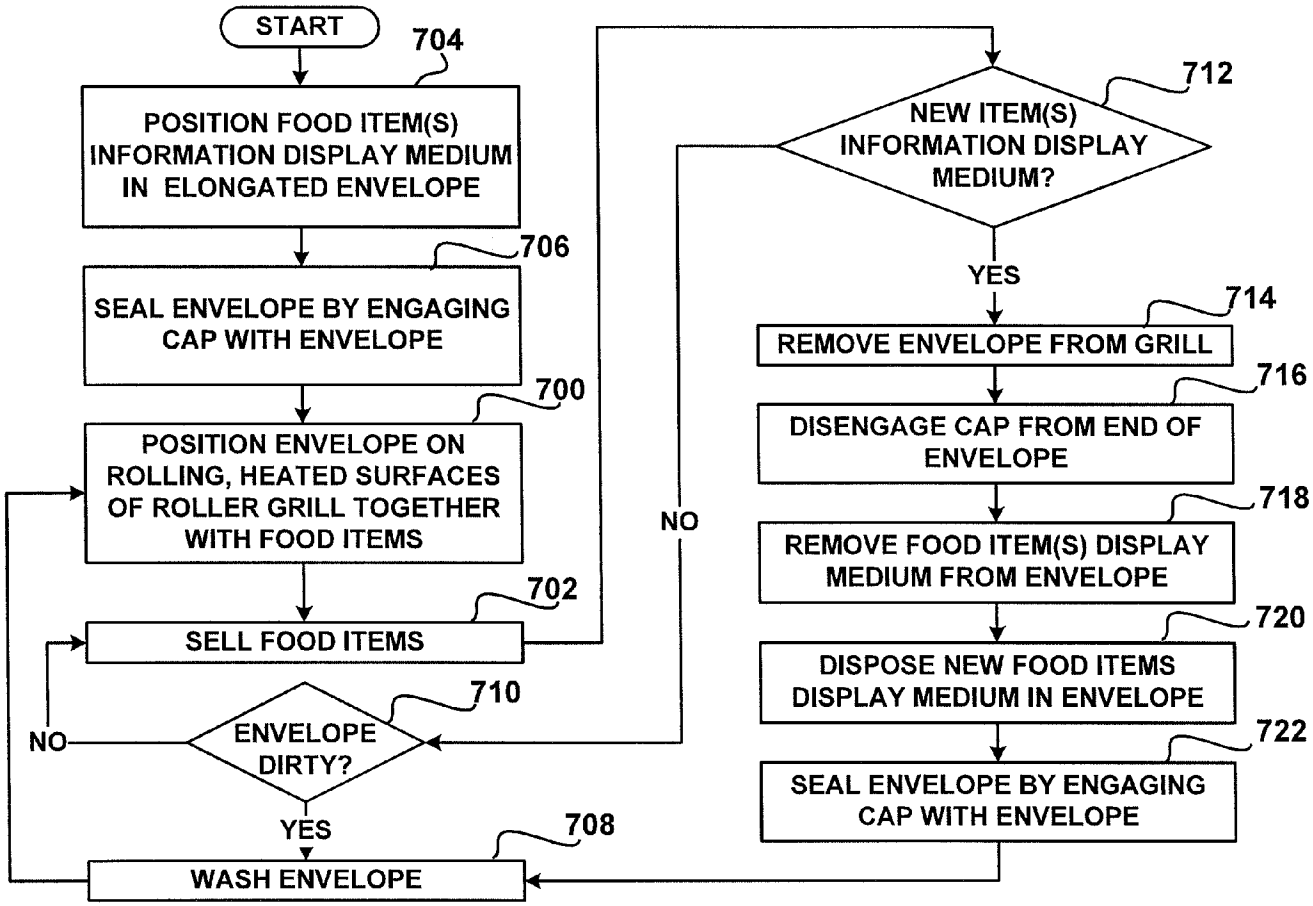
FIG. 7 is a flow diagram illustrating a rolling information display method for use with a roller grill.

Turning now to FIG. 7, a rolling display method for use with a roller grill includes resting or positioning an elongated, light transmissive envelope on rolling heated surfaces of a roller grill at block 700. At 700, the envelope is placed to rest on the grill together with food items about which information is provided on an information bearing medium disposed in the light transmissive envelope. For example, taquitos and hot dogs are placed on the grill, and the information displayed by the information bearing medium includes prices for purchasing the hot dogs and taquitos.

At 702, the food items are sold to customers who have viewed the information. Block 702 constitutes honoring the contractual terms printed on the information bearing medium, such as prices of food items. One skilled in the art will readily appreciate alternative or additional contractual terms that can be printed on the information bearing medium and honored at 702.

In some embodiments, the information bearing medium is disposed in the elongated envelope at step 704, in which the elongated envelope includes portions that are non-opaque or clear so that the information bearing medium is visible. For example, a page of plastic paper bearing food item prices can be rolled up and placed inside the tube. Then the envelope is sealed at block 706 by engaging one or more disengagable caps or covers with the envelope. In some embodiments, 706 includes screwing threaded caps onto threaded ends of the envelope with an O-ring or other sealing member disposed to create an airtight and watertight seal. In some embodiments, 706 includes creating a low humidity environment for the medium. In other words, there is little or no moisture and no source of moisture present in the envelope when the envelope is sealed at step 706. As a result, the interior surface of the envelope does not fog or become opaque when placed on rolling, heated surfaces of a roller grill during a grilling operation of the roller grill, and the medium does not quickly degrade. In some embodiments, the cap is engaged with the envelope in a humidity controlled environment in which the humidity is controlled to be low.

In some embodiments, the envelope is periodically removed from the roller grill and washed at block 708. The washing can occur by hand or machine. A decision to wash the envelope can be made at decision block 710 whenever the envelope is dirty. Alternatively or additionally, the decision to wash can be made at predetermined time intervals.

In some embodiments, a new information bearing medium arrives periodically, which prompts a decision at decision block 712 to remove the envelope from the grill at block 714, disengage or remove the cap from the envelope at block 716, remove the old medium from the envelope at block 718, and dispose or position the new information bearing medium in the envelope at block 720. The envelope is then resealed at block 722, washed at block 708, and replaced on the grill at 700. One or more identical or different messages may be included or placed on the information bearing medium.

It should be readily understood that the method can be modified for use with the cylindrical rolling member of FIG. 6. In this case, the rolling member is placed on the grill with the information already present on the recessed surfaces. When a new rolling member arrives, the old rolling member can be disposed of or set aside. Washing of the rolling member can be performed in some embodiments. In the case that the information is to be changed, but all or part of the rolling member reused, then the information bearing medium is discarded when a new one arrives.

It is envisioned that the example materials listed above can be replaced with various other types of materials. For example, it is envisioned that components of the apparatus can be made of metal, stone, rubber, plastic, wood, paper, or other organic products, glass or other crystals, polyester or other fabrics, paper, etc. One skilled in the art will readily recognize many suitable candidate materials having the requisite heat resistance, appearance, and desired qualities.

In summary, in the embodiments described above, the apparatus is a heat resistant, cylindrical tube, which may include circular, triangular, square, or other polygonal cross-sections, that bears information, and that has at least two tires at or near either end of the tube for rolling on the roller grill. These tires are of substantially equal diameter and are situated in parallel planes orthogonal to a longitudinal axis of the cylinder. The tires are preferably soft and heat resistant to ensure that the tires will not slip on the roller grill surfaces, will not damage the roller grill surfaces, and will not be damaged by placement on the roller grill. The heat resistant, cylindrical tube bears information, for example, by encapsulating an information bearing medium within the non-opaque, air tight, water tight tube in certain embodiments. Alternatively, the information is molded directly into the tube surface, or printed, painted, or placed directly onto the tube surface. As another alternative, the information bearing medium is attached to the tube exterior.

The foregoing description is of exemplary and preferred embodiments of a rolling information display apparatus and method. The invention is not limited to the described examples or embodiments. Alterations and modifications to the disclosed embodiments may be made without departing from the invention. The meaning of the terms used in this specification are, unless expressly stated otherwise, intended to have ordinary and customary meaning and are not intended to be limited to the details of the illustrated structures or the disclosed embodiments. None of the foregoing description is to be read as implying that any particular element, step, or function is an essential element which must be included in the claim scope.

The scope of patented subject matter is defined only by the issued claims.

What is claimed is:

1. A rolling information display apparatus operable to rotate on a heated roller grill having at least a first coated, heated roller positioned adjacent a second coated, heated roller, the rolling information display apparatus comprising:

a substantially symmetrical cylindrical and open tubular rolling member including:

a first rolling surface having a first diameter and operable to roll in contact with the first coated, heated roller and the adjacent second coated, heated roller of the heated roller grill;

a second rolling surface having a second diameter and operable to roll in contact with the first coated, heated roller and the adjacent second coated, heated roller of the heated roller grill; and a recessed surface of a heat resistant material having a third diameter and including information about a food item operable to be offered for sale on the heated roller grill, and the information positioned adjacent the recessed surface of the substantially symmetrical cylindrical and open tubular rolling member, wherein the recessed surface, in operation, is provided between the first rolling surface and the second rolling surface in a region of the substantially symmetrical cylindrical and open tubular rolling member, wherein the third diameter of the recessed surface is less than both the first diameter of the first rolling surface and the second diameter of the second rolling surface of the substantially symmetrical cylindrical and open tubular rolling member, wherein the first diameter of the first rolling surface and the second diameter of the second rolling surface are substantially the same, and wherein the first rolling surface and the second rolling surface of the heated roller grill are: (a) configured to roll when in contact with the first coated, heated roller of the heated roller grill and the adjacent second coated, heated roller of the heated roller grill while the first coated, heated roller and the adjacent second coated, heated roller of the heated roller grill rotate, and (b) comprised of a material that is (i) sufficiently heat resistant to avoid being damaged by contact with the first coated, heated roller and the adjacent second coated, heated roller of the heated roller grill, and (ii) operable to roll with the first coated, heated roller and the adjacent second heated roller of the heated roller grill without damage to coated surfaces of the first coated, heated roller and second coated, heated roller of the heated roller grill during operation.

2. The rolling information display apparatus of claim 1, further comprising:

an information bearing medium on at least a portion of the recessed surfaces.

3. The rolling information display apparatus of claim 2, wherein the information bearing medium is formed as a sheet of material that is wrapped around the recessed surface of the substantially symmetrical cylindrical and open tubular rolling member.

4. The rolling information display apparatus of claim 2, wherein the information bearing medium is formed integrally with at least a portion of the recessed surface of the substantially symmetrical cylindrical and open tubular rolling member.

5. The rolling information display apparatus of claim 1, wherein at least one of the first and second rolling surfaces of the substantially symmetrical cylindrical and open tubular rolling member is removably attachable.

6. The rolling information display apparatus of claim 1, wherein the information is disposed by direct application onto the recessed surfaces.

7. The rolling information display apparatus of claim 1, wherein the first and second rolling surfaces are integral with the recessed surface.

8. The rolling information display apparatus of claim 1, wherein the substantially symmetrical cylindrical and open tubular rolling member includes an opening on both ends.

9. A rolling information display apparatus operable to rotate on a roller grill having at least a first heated roller positioned adjacent a second heated roller, the rolling information display apparatus comprising:

a heat resistant, substantially symmetrical cylindrical tube bearing information on its exterior surface about one or more food products placed on the roller grill, the heat resistant, substantially symmetrical cylindrical tube having a first opening at a first end and a second opening at a second end, the second end opposing the first end;

at least one first tire at or near the first opening of the first end of the heat resistant, substantially symmetrical cylindrical tube and continuous therewith: and at least one second tire at or near the second opening of the second end of the heat resistant, substantially symmetrical cylindrical tube and continuous therewith, wherein the at least one first tire and the at least one second tire are for rolling between the first heated roller and the second heated roller of the roller grill, wherein the at least one first tire at or near the first end and the at least one second tire at or near the second end are of substantially equal diameter and are situated in parallel planes orthogonal to a longitudinal axis of the heat resistant, substantially symmetrical cylindrical tube; and wherein the at least one first tire at or near the first end and the at least one second tire at or near the second end are heat resistant to ensure operable rolling with surfaces of the adjacent first heated roller and second heated roller of the roller grill when rotating, wherein the at least one first tire at or near the first end and the at least one second tire at or near the second end frictionally engage with surfaces of the adjacent first heated roller and second heated roller of the roller grill, when rolling, will not damage surfaces of the adjacent first heated roller and second heated roller of the roller grill, and will not be damaged by placement on the adjacent first heated roller and second heated roller of the roller grill.

10. The rolling information display apparatus of claim 9, wherein the information is molded directly into the exterior surface of the heat resistant, substantially symmetrical cylindrical tube.

11. The rolling information display apparatus of claim 9, wherein the information is at least one of printed or painted directly onto the exterior surface of the heat resistant, substantially symmetrical cylindrical tube surface.

12. The rolling information display apparatus of claim 9, wherein an information bearing medium is attached to the exterior surface of the heat resistant, substantially symmetrical cylindrical tube.

13. The rolling information display apparatus of claim 9, wherein the heat resistant, substantially symmetrical cylindrical tube is at least partially opaque.

14. The rolling information display apparatus of claim 9, wherein the heat resistant, substantially symmetrical cylindrical tube is continuous with the first opening on the first end and the second opening on the second end.

15. A rolling information display apparatus operable to rotate on a heated roller grill having rotating rollers that include at least a first heated roller positioned adjacent a second heated roller, the rolling information display apparatus comprising:

an elongated envelope defined by an exterior surface and having an interior volume, an opening adjacent a first end of the elongated envelope, and an opening adjacent a second end of the elongated envelope;

a first circumferential member positioned adjacent the first end of the elongated envelope, and extending radially outward from the exterior surface of the elongated envelope for contact with and, in operation, for rolling on the first heated roller and the adjacent second heated roller of the heated roller grill;

a second circumferential member positioned adjacent the second end of the elongated envelope, and extending radially outward from the exterior surface of the elongated envelope for contact with and, in operation, for rolling on the first heated roller and the adjacent second heated roller of the heated roller grill; and wherein the interior volume of the elongated envelope extends from the opening adjacent the first end of the elongated envelope to the opening adjacent the second end of the elongated envelope, wherein information is positioned adjacent the exterior surface of the elongated envelope between the first end of the elongated envelope and the second end of the elongated envelope, wherein the exterior surface of the elongated envelope can withstand heat from heated roller grill, wherein the first circumferential member and the second circumferential member are in contact with heated surfaces of the first heated roller adjacent the second heated roller of the heated roller grill for rolling and support the elongated envelope during operation of the heated roller grill so that the first circumferential member and second circumferential member are operable to frictionally engage the first heated roller and the adjacent second heated roller of the heated roller grill, such that the first circumferential member and the second circumferential member roll at substantially the same rates relative to one another without damaging the first heated roller and the adjacent second heated roller as the first heated roller and the second heater roller of the heated roller grill rotate.

16. The rolling information display apparatus of claim 15, wherein the elongated envelope is substantially cylindrical in shape.

17. The rolling information display apparatus of claim 15, wherein information is formed integrally with at least a portion of the exterior surface of the elongated envelope.

18. The rolling information display apparatus of claim 15, wherein the first end is continuous with the elongated envelope.

19. The rolling information display apparatus of claim 15, wherein the second end is continuous with the elongated envelope.

* * * * *

UNITED STATES PATENT AND TRADEMARK OFFICE

CERTIFICATE OF CORRECTION

PATENT NO. : 8,701,323 B2
APPLICATION NO. : 13/344734
DATED : April 22, 2014
INVENTOR(S) : Paula Sanders Fenton It is certified that error appears in the above-identified patent and that said Letters Patent is hereby corrected as shown below:

In the Claims:

Claim 1, col. 8, line 30, replace "surface of the heated roller grill are: (a) configured to roll" with --surface of the tubular rolling member are: (a) configured to roll--.

Signed and Sealed this
Second Day of September, 2014

Michelle K. Lee

Michelle K. Lee
*Deputy Director of the United States Patent and Trademark Office*